US005835271A

United States Patent [19]

Stump et al.

[11] Patent Number: 5,835,271

[45] **Date of Patent: *Nov. 10, 1998**

[54] ENCASED RETROREFLECTIVE ELEMENTS AND METHOD FOR MAKING

[75] Inventors: Larry K. Stump, Hudson; Thomas V. Kusilek, River Falls; David C. May, Hudson, all of Wis.; Terry R. Bailey, Woodbury; Louis C. Belisle, Oakdale, both of Minn.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 496,500

[22] Filed: Jun. 29, 1995

[51] Int. Cl.[6] ..... G02B 5/122; G02B 5/128

[52] U.S. Cl. ..... 359/529; 359/531; 359/532; 359/536; 404/14

[58] Field of Search ..... 359/534, 536, 359/539, 542, 546, 529, 531, 532, 900; 404/16, 14

[56] References Cited

U.S. PATENT DOCUMENTS

| | | | |
|---|---|---|---|
| 2,407,680 | 9/1946 | Palmquist et al. . | |
| 3,274,888 | 9/1966 | Vanstrum et al. . | |
| 3,292,507 | 12/1966 | Vanstrum | 94/1.5 |
| 3,418,896 | 12/1968 | Rideout | 94/1.5 |
| 3,746,425 | 7/1973 | Eigenmann . | |
| 3,879,148 | 4/1975 | Eigenmann . | |
| 3,920,346 | 11/1975 | Wyckoff | 404/14 |
| 3,958,891 | 5/1976 | Eigenmann | 404/16 |
| 4,004,930 | 1/1977 | Tung | 106/19 |
| 4,025,159 | 5/1977 | McGrath . | |
| 4,100,625 | 7/1978 | Tung | 2/410 |
| 4,108,536 | 8/1978 | Eigenmann . | |
| 4,129,397 | 12/1978 | Eigenman | 404/14 |
| 4,157,210 | 6/1979 | Mesman | 350/97 |
| 4,182,548 | 1/1980 | Searight et al. | 350/103 |
| 4,358,217 | 11/1982 | Stone | 404/16 |
| 4,388,359 | 6/1983 | Ethen et al. | 428/143 |
| 4,573,763 | 3/1986 | Thomas | 350/105 |
| 4,575,278 | 3/1986 | Whitney | 404/72 |
| 4,664,966 | 5/1987 | Bailey et al. | 428/203 |
| 4,969,713 | 11/1990 | Wyckoff | 350/109 |
| 5,087,148 | 2/1992 | Wyckoff | 404/12 |
| 5,227,221 | 7/1993 | Hedblom | 428/172 |
| 5,268,789 | 12/1993 | Bradshaw | 359/534 |
| 5,417,515 | 5/1995 | Hachey et al. . | |

FOREIGN PATENT DOCUMENTS

| | | | |
|---|---|---|---|
| 0 397 406 | 11/1990 | European Pat. Off. | E01F 9/08 |
| 0 565 765 A2 | 10/1993 | European Pat. Off. . | |
| 1.349.537 | 12/1963 | France . | |
| 2.222.489 | 10/1974 | France | E01F 9/04 |
| 2 147 525 | 5/1973 | Germany . | |
| 1 372 878 | 11/1974 | United Kingdom . | |
| 1 531 480 | 11/1978 | United Kingdom . | |
| 2 164 762 | 3/1986 | United Kingdom . | |

*Primary Examiner*—James Phan
*Attorney, Agent, or Firm*—Robert H. Jordan; Peter L. Olson

[57] ABSTRACT

A retroreflective element that exhibits exceptional wet retroreflectivity, and a method of manufacturing the same. The retroreflective element includes an assembly having a multi-sided retroreflector and a clear thermoplastic. In one embodiment, the clear thermoplastic is at least partially thermally deformed to create a convex retroreflective dome for capturing high incident angle light rays. The retroreflective elements may be used in a pavement marking system, such as attached to pavement marking tape or deposited in pavement marking paint.

16 Claims, 6 Drawing Sheets

ENCASED RETROREFLECTIVE ELEMENTS AND METHOD FOR MAKING

FIELD OF THE INVENTION

The present invention relates to a retroreflective element and a process for making the same, and in particular, to a retroreflective system suitable for pavement marking exhibiting wet retroreflectivity.

BACKGROUND OF THE INVENTION

Pavement markings such as reflective paints and tapes containing transparent microspheres are widely used to guide motorists along the roadways. Very often pavement markings are retroreflective so that motor vehicle drivers can vividly see the markings at nighttime. Retroreflective pavement markings have the ability to return a substantial portion of incident light toward the source from which the light originated. Light from motor vehicle headlamps is returned toward the vehicle to illuminate road features, e.g., the boundaries of the traffic lanes, for the motor vehicle driver. However, when the surfaces of such pavement markings become wet, the exposed microspheres exhibit significantly reduced retroreflectivity. Typical exposed lens retroreflectors depend on an air interface in conjunction with a glass lens and a diffuse reflector. Water interrupts this relationship, resulting in reduced retroreflective brightness when the article is wet.

Attempts to achieve good retroreflectivity during wet conditions include raised, rigid pavement markers, pavement markers with embossed profiles, and large diameter glass beads. A raised pattern of protuberances on an upper surface of a base sheet may be used to elevate the optical elements above any water or other liquids on the roadway and orient the retroreflective structure more optimally, thereby enhancing retroreflectivity of the pavement marking under wet conditions, such as disclosed in U.S. Pat. Nos. 5,227,221, 5,087,148, 4,969,713, and 4,388,359.

However, these solutions typically suffer from substantial cost limitations and may provide less than desired performance. Although large glass beads or raised pavement markers can aid in draining water off of the lens, even a thin layer of water reduces reflectivity substantially. Additionally, these types of pavement markers become more wettable upon degradative exposure to sunlight and road abrasion, so that this effect becomes more pronounced. Raised markers used for temporary marking applications tend to scar or damage the road surface when removed. In some locations, raised markers are subject to damage from snow plows. Finally, raised markers do not provide adequate lane definition in daylight and are generally used in combination with other forms of pavement marking.

Thus, there exists a need for a low-cost retroreflective element for use on pavement marking and other applications that provides good retroreflectivity during wet conditions.

SUMMARY OF THE INVENTION

The present invention provides a retroreflective element that exhibits exceptional wet retroreflectivity, and a method of manufacturing the same. The retroreflective element comprises an assembly of a multi-sided retroreflector and a clear thermoplastic resin. In one embodiment, the thermoplastic is thermally deformed to create a convex reflective dome that substantially encases the multi-sided retroreflector. The dome structure improves retroreflectivity of high incident light rays. The multi-sided retroreflector may be randomly or uniformly oriented relative to the convex dome of the retroreflective elements.

In one embodiment, a multi-sided retroreflector is laminated between at least two sheets of a clear plastic. The laminate is formed into retroreflective elements, e.g., cubes, cylinders, etc., that can provide random orientation of the multi-sided retroreflector when deposited on a substrate or other surface. The retroreflective elements may be covered with an overcoating, such as a thermoplastic. The overcoating may create a surface that assists in retroreflection of high incident light rays.

The multi-sided retroreflector may include first and second layers of transparent microspheres positioned in optical association with opposite sides of a reflecting layer, such as a specular, diffuse, or pigmented reflector. In an alternate embodiment, the multi-sided retroreflector may have three or more surfaces with retroreflective properties. Enclosed lens retroreflectors, such as embedded lens or encapsulated lens microsphere-based retroreflectors or prismatic retroreflectors, may be utilized in constructing the present retroreflective elements. Additionally, the reflecting layer may either be a specular reflector or a reflecting pigment.

The present invention is also directed to a wet retroreflective pavement marking system in which a plurality of the present retroreflective elements are adhered to a pavement surface by a variety of techniques. For example, a pavement marking paint may be used as a bonding material to attach the present retroreflective elements to a pavement surface. Glass beads may also be added to the pavement marking paint to provide additional dry retroreflectivity. Alternatively, the retroreflective elements may be bonded to a pavement marking tape. In yet another embodiment, the present retroreflective elements may be thermally laminated between two thermoplastic sheets. The assembly of thermoplastic sheets and retroreflective element is then bonded to a suitable substrate prior to attachment to the pavement.

The present invention is also directed to a method of preparing a retroreflective element which includes forming an assembly of a multi-sided retroreflector and a clear thermoplastic resin. The method of forming the assembly may include laminating the retroreflector between first and second sheets of clear thermoplastic resin. The resulting assembly is then divided into a plurality of pieces which may be circles, squares, hexagons, or a variety of other shapes. A plurality of the resulting retroreflective elements may be thermally or adhesively bonded to a pavement surface or a pavement marking tape. Alternatively, the retroreflective element may be thermally bonded between an upper and a lower thermoplastic sheet. In one embodiment, a portion of the thermoplastic resin is thermally deformed to define a convex dome that substantially encases the multi-sided retroreflector.

In an alternate embodiment, the multi-sided retroreflector is divided into a plurality of multi-sided retroreflectors pieces, which are then mixed with the clear thermoplastic resin and extruded to form an extruded retroreflective member. The resulting extruded retroreflective member may be divided into a plurality of extruded member pieces, which are subsequently thermally deformed to form the convex dome. If desired, the extruded member pieces may be deposited on a substrate. The extruded retroreflective member may have a circular cross-section or a variety of other shapes suitable for forming the present retroreflective elements. The extrusion process may be used to form a retroreflective fiber suitable for weaving into fabrics or other woven materials.

The present method also includes extruding the multi-sided retroreflector generally within the clear thermoplastic resin to form an extruded retroreflective member. The multi-sided retroreflector may be twisted during the extruding process so as to further randomize the orientation of the multi-sided retroreflector within the extruded retroreflective member. The extruded retroreflective member is then divided into a plurality of extruded member pieces, which are thermally deformed to define convex domes.

Definitions used in this application:

"Multi-sided retroreflector" means a retroreflector having retroreflective properties on two or more sides.

"Clear thermoplastic resin" means for example acrylics, polycarbonates, polyurethanes, polyolefins, polyesters, fluoropolymers, polyvinyl chloride or other clear thermoplastic materials resistant to abrasion, salt, water, oil, and ultraviolet light, having low color and cost, and having a heat deflection or softening temperature greater than the temperatures typically encountered on roadway surfaces.

"Convex dome" means a regular or irregular shaped surface at least a portion of which is convex.

"Enclosed-lens retroreflector" as used herein comprise a monolayer of microspheres having a reflective layer in optical association with the rear surfaces thereof, sometimes spaced apart by a spacing layer, and a cover layer in which the front surfaces of the microspheres may be embedded.

"Embedded-lens retroreflectors" comprise a monolayer of microspheres having a reflective layer in optical association with the rear surface thereof, spaced apart by a spacing layer, and a cover layer in which the front surfaces of the microspheres are embedded.

"Encapsulated-lens retroreflectors" as used herein comprise a monolayer of microspheres with reflective means in association with the rear surfaces and a cover film disposed to the front surface thereof or a layer of cube corner elements with a cover film sealed to the rear surface thereof.

"High incident angle light rays" means light rays of approximately greater than 80 degrees from vertical, and typically between 86 and 90 degrees, such as may be generated by headlights on vehicles illuminating a pavement surface or vertical barrier parallel to the road surface, for example a Jersey barrier.

"Prismatic retroreflectors" are retroreflectors having an array of cube corner elements with either a sealed air pocket or a specular reflector as the reflecting means.

"Wet reflectivity" means a system that retains a substantial portion of its dry retroreflectivity when wetted.

BRIEF DESCRIPTION OF THE DRAWINGS

The invention will be further explained with reference to the drawings, wherein.

These figures, which are idealized, are not to scale and are intended to be merely illustrative and nonlimiting.

DETAILED DESCRIPTION OF ILLUSTRATIVE EMBODIMENTS

Figure 1:
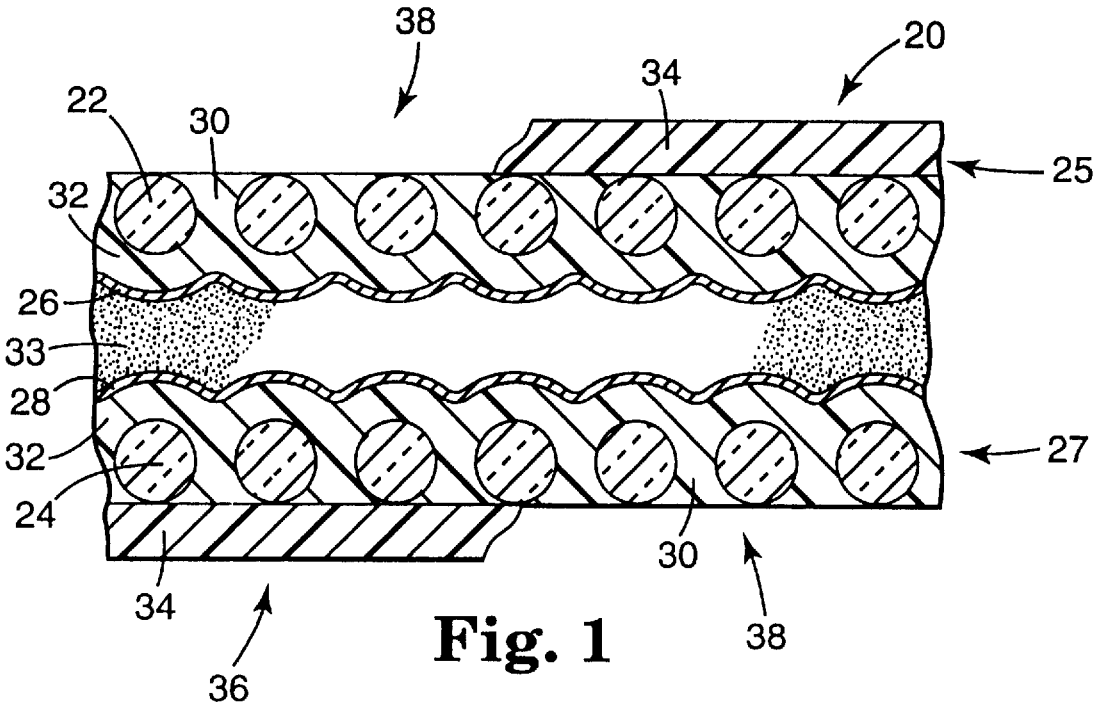
FIG. 1 is a cross-section of a portion of a first exemplary multi-sided retroreflector.

FIG. 1 illustrates an exemplary multi-sided retroreflector 20 of the present invention. A first layer of transparent microspheres 22 is held in a fixed relationship relative to reflecting layer 26 by a transparent binder layer 30 to form an upper retroreflector 25. A second layer of transparent microspheres 24 is held in a fixed relationship relative to reflecting layer 28 by transparent binder layer 30 to form a lower retroreflector 27. Transparent space layers 32 are interposed between the layer of microspheres 22, 24 and the reflecting layers 26, 28, respectively.

An adhesive 33 joins the upper and lower retroreflectors 25, 27 to form the multi-sided retroreflector 20. It will be understood that the upper and the lower retroreflectors 25, 27 may alternatively be formed as a unitary structure. In one embodiment, a transparent film 34 covers the microspheres 22, 24 to form an embedded lens retroreflector 36. In an alternate embodiment, the multi-sided retroreflector 20 may operate without the transparent film 34.

Figure 2:
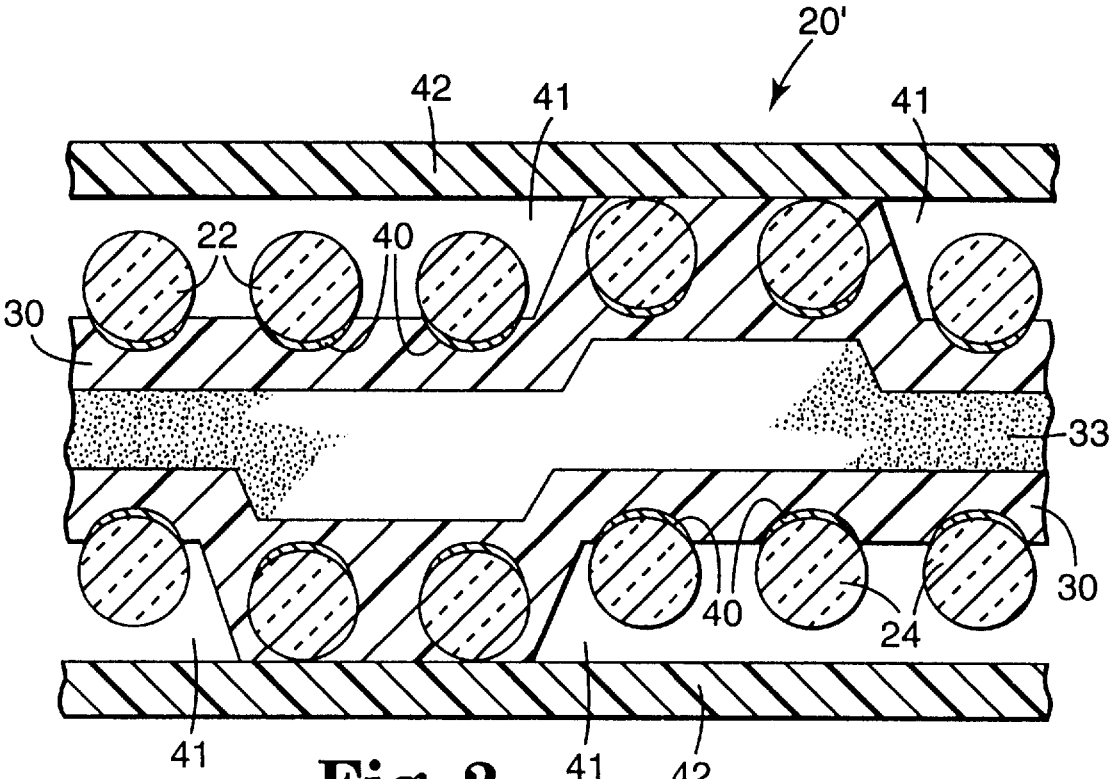
FIG. 2 is a cross-section of a portion of a second exemplary multi-sided retroreflector.

FIG. 2 is a cross-sectional view of an alternate multi-sided retroreflector 20' having an upper layer of microspheres 22 and a lower layer of microspheres 24, each fixed in a binder layer 30. The binder layers are joined back-to-back by an adhesive 33. A reflecting layer 40 is deposited on the rear surface of the microspheres 22, 24. A transparent film 42 is applied to the multi-sided retroreflector 20' to create an air gap 41 and encapsulate the microspheres 22, 24. It will be understood that the multi-sided retroreflectors 20 and 20' may be combined in a single retroreflective element. The transparent films 34, 42 are typically between 0.025 to 0.13 mm in thickness, though it will be understood that the thickness may vary depending upon the particular application. For example, where the retroreflectors 20, 20' are to be formed into cubic structures (see FIG. 4) or where the transparent films 34, 42 are to be thermally deformed to create retroreflective elements such as in FIGS. 10–12, the transparent films 34, 42 may be 1.0 to 2.0 millimeters (mm) thick.

Figure 1A:
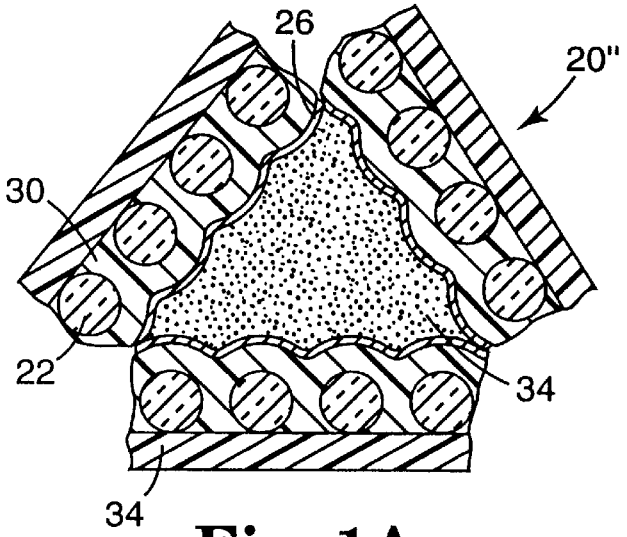
FIG. 1A is a cross-section of a retroreflector having retroreflective properties on three sides.

FIG. 1A is a sectional view of a multi-sided retroreflector 20" with three layers of microspheres 22 joined by an adhesive 34. The microspheres 22 are held in a fixed relationship with the reflecting layer 26 by a transparent binder 30. The transparent film 34 may optionally be attached to the outer surface of the microspheres 22. The three sided retroreflector 20" may be constructed as a unitary structure or by attaching layers of microspheres to a triangular substrate. It will be understood that the present invention is not limited to two or three sided retroreflectors and that more complex, multi-sided retroreflector structures may be used herein.

Illustrative examples of a microsphere-type and a cube-corner type encapsulated lens retroreflector that may be used in the present invention are disclosed in U.S. Pat. No. 4,025,159 to McGrath, which is hereby incorporated by reference. An illustrative example of an embedded lens retroreflector that may be used in the present invention is disclosed in U.S. Pat. No. 2,407,680 to Palmquist, which is also incorporated by reference. A variety of commercially available retroreflectors products may be used to construct the multi-sided retroreflectors 20, 20', 20" of the present invention. Examples of commercially available enclosed lens retroreflectors with and without a transparent film covering include SCOTCHLITE Band reflective sheeting products Series 3750 and 4750, respectively, available from Minnesota Mining and Manufacturing Company ("3M"), St. Paul, Minn. An example of a flexible, encapsulated retroreflector includes SCOTCHLITE Brand reflective sheeting products Series 3810-I available from 3M, St. Paul, Minn. Examples of commercially available prismatic retroreflectors include SCOTCHLITE Brand reflective sheeting products Series 3990 and 3970G available from 3M, St. Paul, Minn.

The microspheres 22, 24 are generally less than about 200 micrometers in diameter and greater than about 25 micrometers in diameter. Preferably, the microspheres are between approximately 60 and 90 micrometers in diameter. The glass microspheres (also known as beads) 22, 24 are formed of glass materials having indices of refraction of from about 1.8 to about 2.9, and more particularly approximately 1.9 for encapsulated retroreflectors and 2.3 for enclosed lens retroreflectors. Illustrative examples of suitable specular reflectors for the reflecting layers 26, 28, 40 include aluminum and silver. It will be understood that microspheres having average diameters and indices of refraction outside these ranges may be used if desired.

Polyvinyl butyral, polyester, and polyurethane extended polyester are illustrative examples of materials useful for the binder layer 30. The transparent films 34, 42 and thermoplastic 52 (discussed below) may be constructed, for example, of aliphatic urethane, ethylene copolymers such as ethylene acrylic acid, ethylene methacrylic acid or ionically crosslinked versions thereof. It will be understood that the thermoplastic 52 may contain small portions of thermoset or lightly-crosslinked materials. The thermoplastic 52 preferably has a refractive index in the range of 1.33 to 1.6 and are at least 70 percent transparent as measured by ASTM D1003. The thermoplastic 52 and transparent film 34, 42 are typically selected based on good adhesion therebetween.

Figure 3:
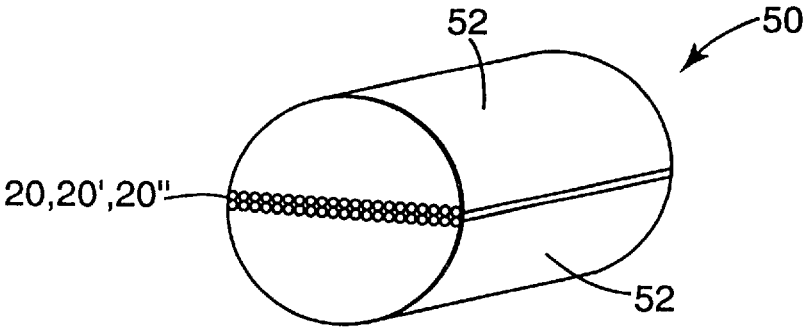
FIG. 3 illustrates an exemplary cylindrical retroreflective assembly with the retroreflective sheet longitudinally oriented.

FIG. 3 illustrates a cylindrical retroreflective assembly 50 in which the multi-sided retroreflector 20, 20', 20" is laminated in a cylindrically shaped clear thermoplastic 52, e.g., having a diameter of about 1 to 5 mm. The cylindrical retroreflective assembly 50 may then be cut or broken into a plurality of pieces of desired dimension. The cylindrical shape of the assembly 50 allows for random orientation of the multi-sided retroreflector 20, 20', 20" when deposited on a substrate (see FIG. 13). In one embodiment, the assemblies 50 are deposited on a substrate and thermally deformed to create the convex retroreflective domes of the present retroreflective elements (see FIGS. 10–12).

Figure 4:
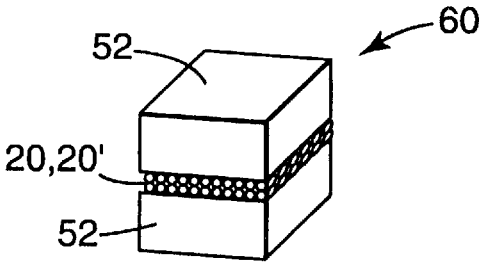
FIG. 4 illustrates an exemplary square retroreflective assembly.
Figure 5:
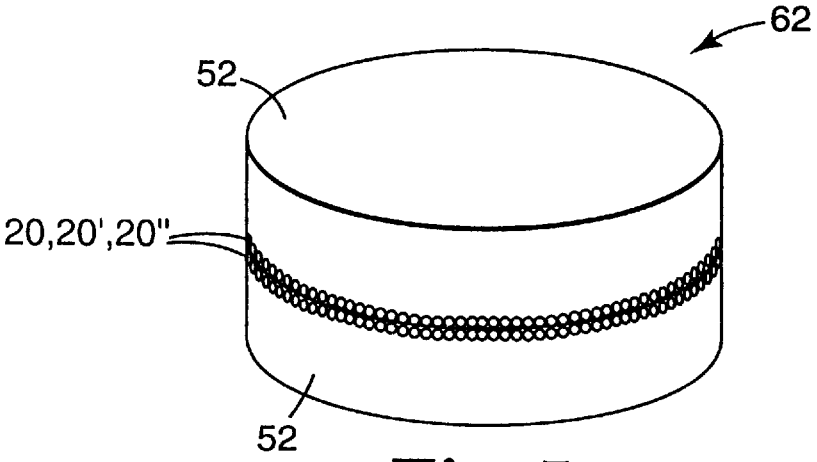
FIG. 5 illustrates an exemplary cylindrical retroreflective assembly.

FIGS. 4 and 5 illustrate cubic and cylindrical retroreflective assemblies 60, 62, respectively, in which a multi-sided retroreflectors 20, 20', 20" are laminated between a clear thermoplastic 52. The thermoplastic layer resin 52 preferably has a thickness of about 0.25 to 2 mm, and typically most preferably about 0.6 to 1.5 mm. The cubic and cylindrical retroreflective assemblies 60, 62 may be formed by stamping or cutting a sheet of retroreflective assembly material into a desired shape and size. In one embodiment, the retroreflective assemblies 60, 62 are deposited on a substrate and thermally deformed to create domed retroreflective elements 80 (see FIGS. 10–12).

It has been found that the square retroreflective assembly 60 may not consistently encase the multi-sided retroreflectors 20, 20', 20" during the thermal deformation process. In particular, corners of the retroreflectors 20, 20', 20" may protrude through the thermoplastic 52, creating points of weakness or peel points that may compromise the retroreflective elements. The cylindrical retroreflective assembly 62 provides a more uniform distribution of the thermoplastic 52 during thermal deformation. However, cutting the cylindrical retroreflective assemblies 62 from a sheet of retroreflective assembly material generates a greater quantity of scrap material. A hexagonal shaped retroreflective assembly represents a compromise between consistent encapsulation of the multi-sided retroreflector 20, 20', 20" and minimum quantity of scrap material.

Figure 6:
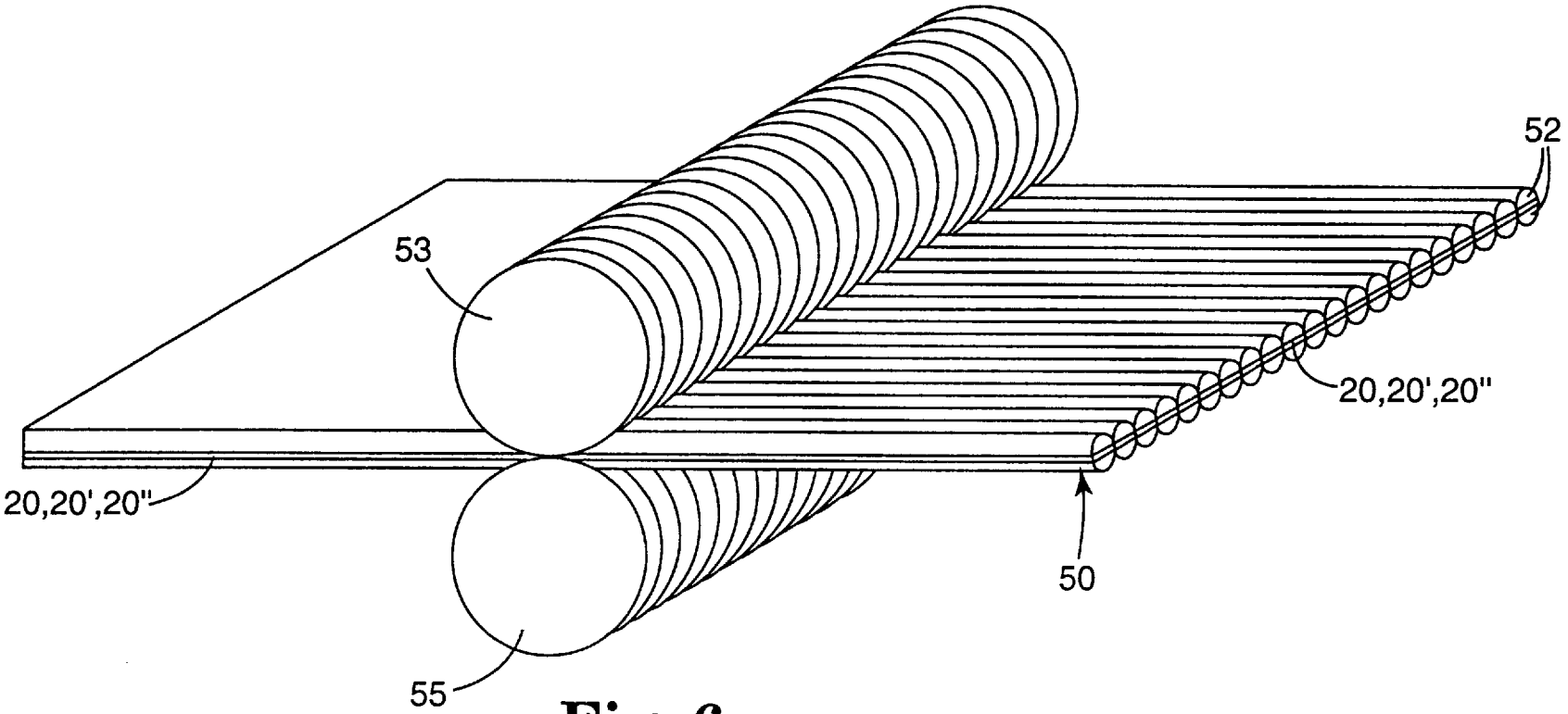
FIG. 6 illustrates an exemplary die for forming a plurality of the cylindrical retroreflective assemblies of FIG. 3.

FIG. 6 illustrates an exemplary thermal forming roll 51 having an upper roll 53 and a lower roll 55 for simultaneously forming multiple cylindrical retroreflective assemblies 50 (see FIG. 3) containing retroreflectors 20, 20', 20". Sheets of the thermoplastic 52 are thermally deformed by the rolls 53, 55 to produce a plurality of the retroreflective assemblies 50. As will be discussed in detail below, the plurality of cylindrical retroreflective assemblies 50 are separated and subsequently divided or cut into a plurality of pieces. These piece may be deposited on a substrate (see FIG. 13) or thermally deformed to create the present retroreflective elements (see FIGS. 10–12).

Figure 7:
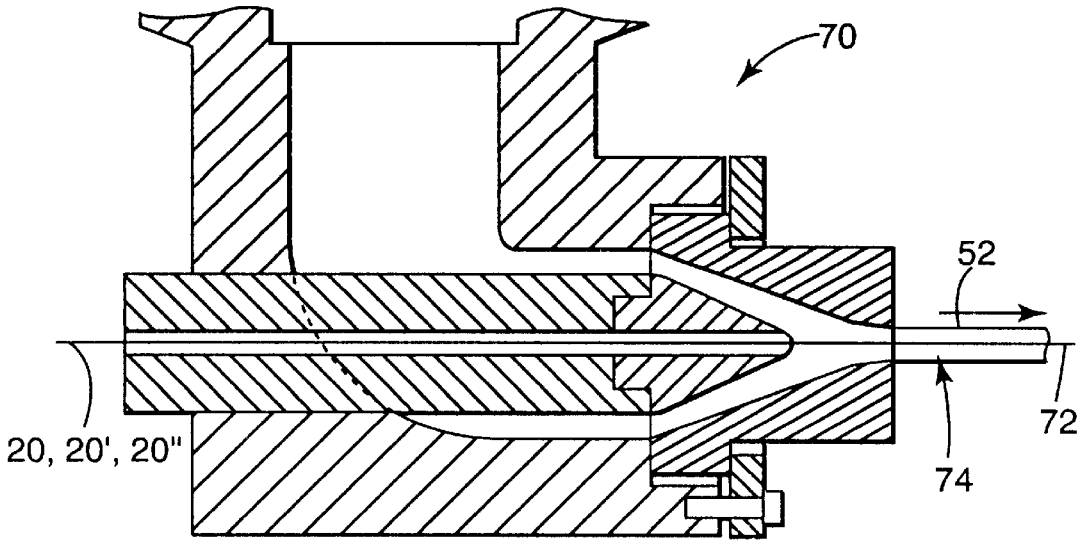
FIG. 7 illustrates a conventional wire coating extrusion process for forming an extruded retroreflective member.

FIG. 7 is a sectional view of an exemplary wire extrusion system 70, in which a filament 72 may be embedded in the thermoplastic 52 to assist in the formation of an extruded retroreflective member 74. In some applications, the multi-sided retroreflector 20, 20', 20" may have sufficient tensile strength to assist in forming the extruded retroreflective member 74 without the filament 72. FIG. 8A illustrates the cylindrically enclosed extruded retroreflective member 74, manufactured using the wire extrusion system 70 of FIG. 7. It will be understood that coating of the filament 72 with the thermoplastic 52 may be accomplished by either high solids liquid coating or conventional wire coating thermoplastic extrusion. Additionally, the cross section of the extruded retroreflective member 74 may be a variety of shapes, such as square, triangular, hexagon, etc.

Figure 8B:
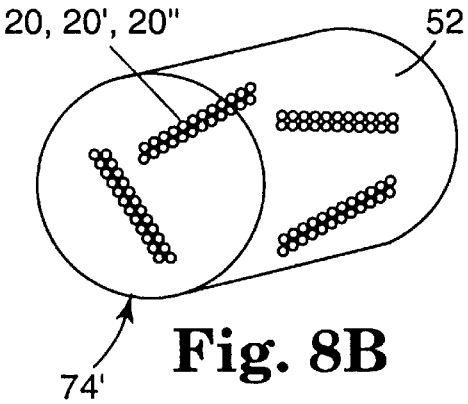
FIG. 8B illustrates an alternate cylindrical, extruded retroreflective member having randomized multi-sided retroreflector pieces.
Figure 8A:
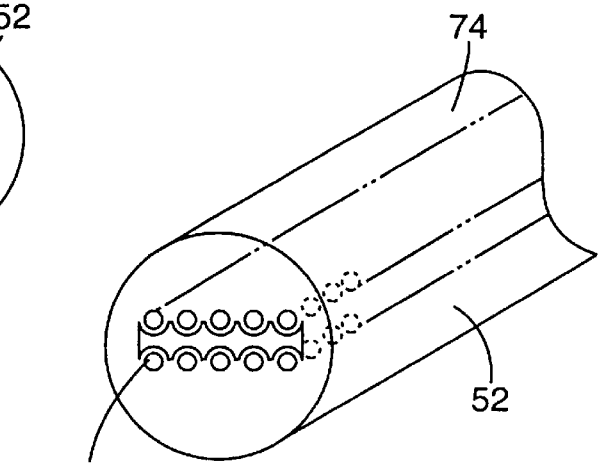
FIG. 8A is a perspective view of an extruded retroreflective member.
Figure 9:
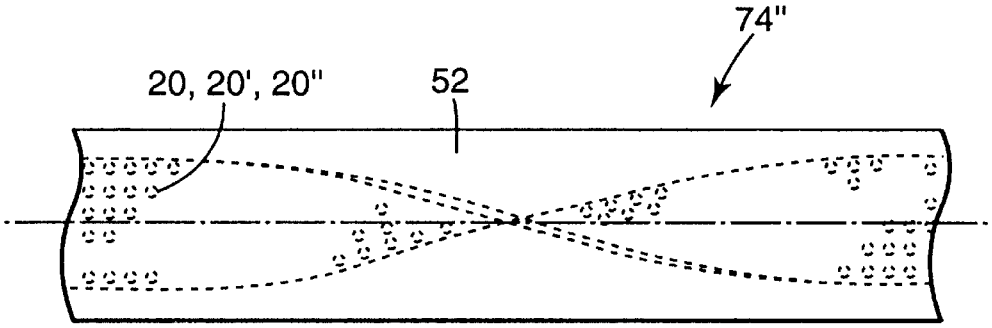
FIG. 9 is an alternate embodiment of the extruded retroreflective member of FIG. 8 in which the multi-sided retroreflector is twisted during extrusion.

FIG. 8B is an alternate embodiment in which the multi-sided retroreflectors 20, 20', 20" are broken into a plurality of pieces and randomly dispersed into the thermoplastic 52 prior to extrusion of the extruded retroreflective member 74'. FIG. 9 is an alternate embodiment of a cylindrically enclosed retroreflector element 74" in which the multi-sided retroreflector 20, 20', 20" is twisted during the extrusion process. As with the retroreflective assemblies 50, 60, 62 of FIGS. 3, 4, and 5, the extruded retroreflective members 74, 74', 74" preferably are cut or broken into a plurality of pieces as desired prior to the thermal deformation process.

In one illustrative embodiment, the extruded retroreflective members 74, 74', 74" are formed into fine strands having a diameter of approximately 1 to 5 mm. A flexible or semi-rigid thermoplastic 52 such as polyester, nylon or vinyl provides the members 74, 74', 74" with sufficient flexibility to be woven into a fabric, so as to give the fabric retroreflective properties.

Figure 10:
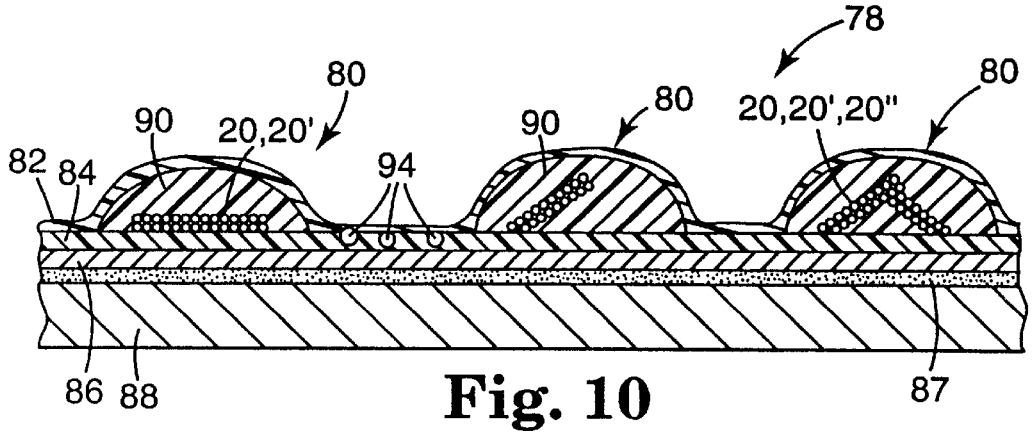
FIG. 10 is a cross-sectional view of a retroreflective pavement marking system in which the retroreflective elements are encased in thermoplastic sheets.

FIG. 10 is a sectional view of a pavement marking system 78 having a plurality of retroreflective elements 80. The layer of thermoplastic 84 is extrusion coated to a substrate 86 and may contain pigments and other additives as desired. Suitable substrates include metal foil, or plastics or rubbers having low elasticity and high permanent deformation properties. The retroreflective assemblies 50, 60, 62 and/or extruded retroreflective members 74, 74', 74" are then deposited on the thermoplastic layer 84 and thermally deformed to create the retroreflective elements 80. Glass beads 94 may optionally be deposited on the thermoplastic layer 84. An overcoat of a transparent thermoplastic 82 may also be applied to the system 78 in which case glass beads 94 should have an index of refraction of about 2.1 or more. The substrate 86 is bonded to a road pavement surface 88 by a suitable adhesive 87. A variety of embodiments of substrate 86 and adhesive 87 as are well known in the art may be used in the present invention. The thermoplastic sheets 82, 84 are preferably constructed from a thermoplastics resin that has good bonding properties with the thermoplastic 52 of the retroreflective elements 80. The retroreflective elements 80 generally extend above any water present on the pavement 88 so that high incident light rays may be captured by the convex retroreflective domes 90 surrounding the multi-sided retroreflectors 20, 20', 20". Water that coats the retroreflective elements 80 does not inhibit retroreflectivity.

Figure 11:
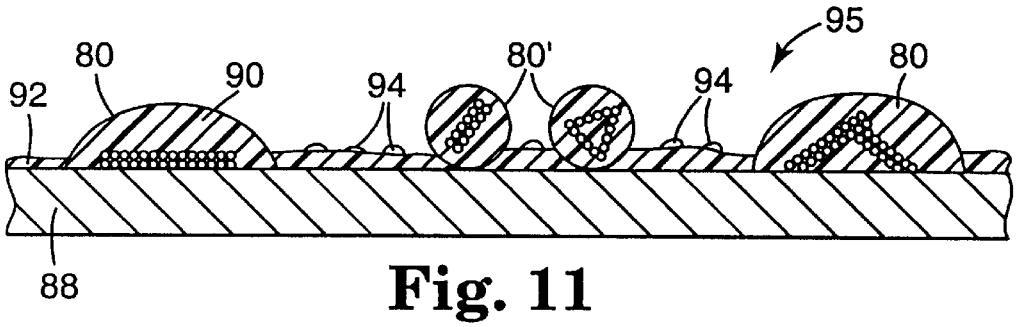
FIG. 11 is a cross-sectional view of a retroreflective pavement marking system in which the retroreflective elements are deposited in pavement marking paint.

FIG. 11 illustrates an alternate pavement marking system 95 in which the thermally deformed retroreflective elements 80, 80' are deposited into a pavement marking paint 92. The convex retroreflective domes 90 of the retroreflective elements 80 are generally oriented upward due to their shape. However, it will be understood that random dispersion of the elements 80 may result in some of the retroreflective elements 80 being oriented upside down although the spherical retroreflective elements 80' are orientation independent. Glass beads 94 may also be deposited in the pavement marking paint 92, as is conventionally done in the art.

Figure 12:
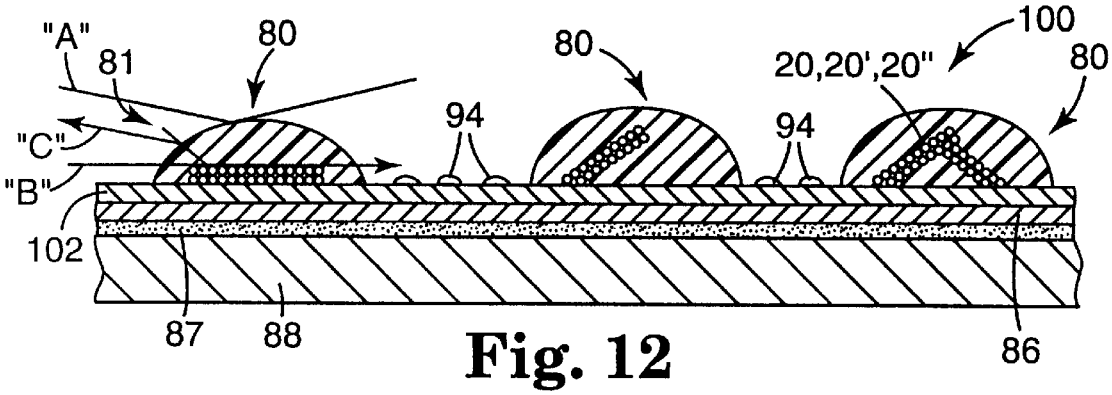
FIG. 12 is a cross-sectional view of a retroreflective pavement marking system in which the present retroreflective elements are attached to a substrate.

FIG. 12 is a sectional view of an alternate pavement marking system 100, in which the retroreflective elements 80 are bonded to a substrate 102, such as the thermoplastic sheets discussed above. The retroreflective elements may be thermally bonded directly to the substrate 102 or attached via a suitable adhesive. The substrate 102 is then attached to a second substrate 86, such as metal foil, which is attached to the pavement 88 by an adhesive 87.

FIG. 12 also illustrates the operation of present retroreflective elements 80 with high incident angle light rays A–C. Light ray B strikes the retroreflective element 80 substantially normal or perpendicular to the surface thereof. Consequently, the light may pass through the element 80 without refracting or striking the multi-sided retroreflector 20, 20', 20" depending upon the orientation and position of the multi-sided retroreflector. Light ray A strikes the surface of the element 80 at a shallow angle and is deflected with very little refraction. Light ray C enters the element 80, is refracted toward the multi-sided retroreflector 20, 20', 20" and is reflected back to its source. The area between the light rays A and B is the effective aperture of the element 80. The effective aperture will depend upon the shape of the dome 90 and the orientation of the multi-sided retroreflectors 20, 20', 20".

Figure 13:
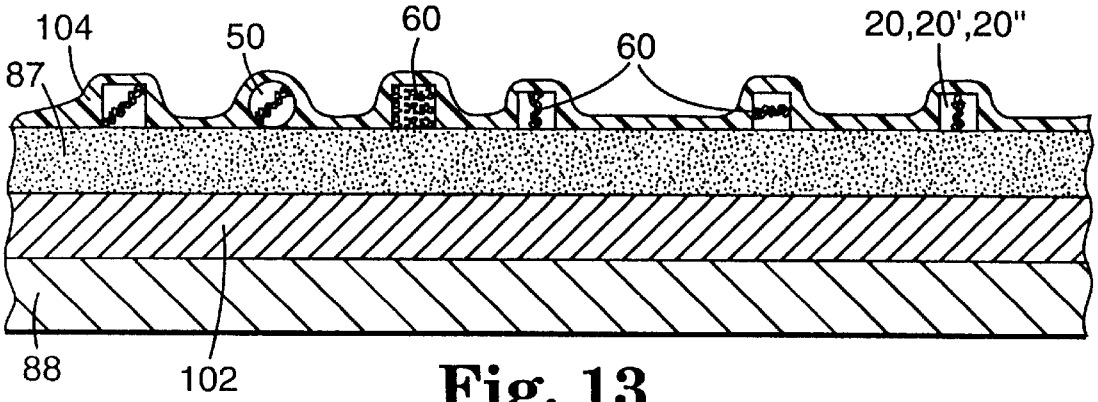
FIG. 13 is a cross-sectional view of a retroreflective pavement marking system in which retroreflective elements are attached to a substrate.

FIG. 13 is an alternate embodiment in which the cubic retroreflective assemblies 60 of FIG. 4 and the cylindrical retroreflective assemblies 50 of FIG. 3 are attached to a substrate 102 by an adhesive 87. The cubic and cylindrical shape of the retroreflective assemblies 50, 60 permit random orientation of the multi-sided retroreflectors 20, 20', 20". A clear overcoating 104, such as a thermoplastic, may be applied to protect the assemblies 50, 60 and to enhance retroreflectivity. However, it will be understood that the cylindrical retroreflective assemblies 62, as well as other shapes, may be suitable for this purpose.

The method of the present invention includes generally encasing the multi-sided retroreflector 20, 20', 20" in the clear thermoplastic 52 by a variety of techniques (see FIGS. 3–9). In one embodiment, the multi-sided retroreflector 20, 20', 20" is laminated between sheets of clear thermoplastic 52 (see FIGS. 3–6). The resulting assemblies 50, 60, 62 are then cut or divided into a plurality of pieces, such as cylinders, circles, squares, hexagons, or a variety of other shapes.

Alternatively, the multi-sided retroreflector 20, 20', 20" may be extruded in a clear thermoplastic 52 to form an extruded retroreflective member 74, 74', 74" (see FIGS. 7–9). The resulting extruded retroreflective member 74, 74', 74" may be divided into a plurality of extruded member pieces. In an alternative embodiment, the extruded retroreflective members 74, 74', 74" forms a fiber or filament that may be woven into fabrics or other woven materials.

The assemblies 50, 60, 62 and extruded members 74, 74', 74" may be deposited on substrate (such as a pavement marking tape) or directly to the pavement surface and optionally covered with a suitable overcoating. Alternatively, assemblies 50, 60, 62 and extruded members 74, 74', 74" may be deposited on a substrate and thermally deformed to define the convex domes 90 of FIGS. 10–12.

The invention will be further explained by the following illustrative examples.

EXAMPLE 1

A 0.38 mm (0.015 inch) thick sheet of polyethylene acrylic acid resin sold under the tradename PRIMACOR™ 5980 (available from E. I. duPont de Nemours and Company of Wilmington, Del.) was extruded onto a 0.061 mm (0.0024 inches) thick polyethylene terephthalate carrier web (herein called PET) using common thermoplastic extrusion coating techniques. To make a thicker sheeting, three layers of the PRIMACOR™ were laminated together using a heated roller at about 121° C. (250° F.) (although a thicker layer could have been extruded initially if desired). A SCOTCHLITE Brand reflective sheeting product series 3750 (available from 3M Company, St. Paul, Minn.) was primed with MORTON ADCOTE 50T4983 (available from Morton Chemical Co.), using common gravure coating and drying techniques, with the ADCOTE solution thinned with 10% Isopropanol to facilitate wetting of the 3750. Then the laminated PRIMACOR™ 5980 sheeting was hot laminated to the series 3750 reflective sheeting again using common hot laminating techniques of a heated roller and a rubber pressure roller. Lamination was done at 138° C. (280° F.) and 6.1 meters/min. (20 FPM). After the assembly sheeting was removed from the heated roller, the web was quickly cooled by passing the hot assembly sheeting around a series of cold rollers before winding the sheet into a roll. Two sheets of the assembly sheet (PRIMACOR™ 5980 laminated to series 3750 reflective sheeting) were laminated together at room temperature to form the multi-sided retroreflector of FIG. 1 by removing the release liner from the series 3750 reflective sheeting to expose the pressure sensitive adhesive and passing the sheets past a rubber pressure roller.

The resulting multi-sided retroreflector was cut into approximately 2.54 mm (1/10") squares to form a nearly cubic element as shown in FIG. 4. The squares were deposited on a white pigmented polyethylene methacrylic acid film (20 weight percent TI02 sold under the tradename NUCREL™ 699 also available from duPont) that was extruded about 0.11 mm (4.5 mil) thick onto 0.076 mm (3 mil) thick aluminum foil. The film/foil laminate was preheated to 149° C. (300° F.) before distributing the enclosed sheeting elements. The assembly was placed in a 204° C. (400° F.) oven for approximately one minute, allowing the heat to partially melt, and thus shape the PRIMACOR™ resin to form the circular domes generally illustrated in FIGS. 10–12. Under these conditions the multi-sided retroreflectors were generally encased in the clear PRIMACOR™ 5980 resin, although some of the corners of the multi-sided retroreflectors did protrude out from the resin. Approximately 1.14 mm (0.045 inches) of clear resin was used on each side of the retroreflector in the example.

EXAMPLE 2

Retroreflective elements as defined in Example 1 were formed, except that the resulting enclosed sheeting elements were cut into circular pieces as illustrated in FIG. 5. The cylindrical configuration was observed to minimize the chance for the multi-sided retroreflector 20, 20', 20" to protrude through the clear thermoplastic resin following thermal deformation, and thereby possibly cause peel points.

EXAMPLE 3

Small pieces of the multi-sided retroreflector of Example 1 were added to a molten mix of clear thermoplastic and the mixture was extruded into strands as illustrated in FIGS. 8A, 8B, and 9. The strands were later cut into small cylindrical pellets and heated to form the convex retroreflective domes illustrated in FIGS. 10–12.

It will be understood that the exemplary embodiments in no way limit the scope of the invention. Other modifications of the invention will be apparent to those skilled in the art in view of the foregoing descriptions. These descriptions are intended to provide specific examples of embodiments which clearly disclose the invention. Accordingly, the invention is not limited to the described embodiments or to the use of specific elements, dimensions, materials or configurations contained therein. All alternative modifications and variations of the present invention which fall within the spirit and broad scope of the appended claims are covered.

What is claimed is:

1. In combination:

(a) an adhesive material, and (b) a plurality of discrete rigid retroreflective elements each comprising a multi-sided retroreflector and a clear thermoplastic resin encasing the multi-sided retroreflector, the retroreflective elements adhered by the adhesive material to a surface at random orientations with respect to each other to provide non-directional retroreflection.

2. The combination of claim 1, wherein the multi-sided retroreflector comprises first and second back-to-back retroreflectors.

3. The combination of claim 1, wherein the multi-sided retroreflector comprises first and second layers of transparent microspheres positioned in optical association with a reflecting layer on opposite sides thereof.

4. The combination of claim 3, wherein the multi-sided retroreflector further includes a transparent spacing layer interposed between at least the first layer of transparent microspheres and a reflecting layer.

5. The combination of claim 4, wherein the multi-sided retroreflector comprises a first reflecting layer in optical association with a first layer of microspheres and a second reflecting layer in optical association with a second layer of microspheres.

6. The combination of claim 3, wherein the reflecting layer is a specular reflector.

7. The element of claim 1, wherein the clear thermoplastic resin is selected from a group consisting of acrylics, polycarbonates, polyurethanes, polyolefins, polyesters, fluoropolymers, and polyvinyl chloride.

8. In combination:

a) a road surface;

b) a plurality of discrete rigid retroreflective elements each comprising a multi-sided retroreflector and a clear thermoplastic resin encasing the multi-sided retroreflector; and c) an adhesive adhering the retroreflective elements to the road surface at random orientations with respect to each other to provide non-directional retroreflection.

9. The combination of claim 8, wherein the multi-sided retroreflector comprises first and second back-to-back retroreflectors.

10. The combination of claim 8, wherein the multi-sided retroreflector comprises first and second layers of transparent microspheres positioned in optical association with a reflecting layer on opposite sides thereof.

11. The combination of claim 10, wherein the multi-sided retroreflector further includes a transparent spacing layer interposed between at least the first layer of transparent microspheres and a reflecting layer.

12. The combination of claim 11, wherein the multi-sided retroreflector comprises a first reflecting layer in optical association with a first layer of microspheres and a second reflecting layer in optical association with a second layer of microspheres.

13. The combination of claim 10, wherein the reflecting layer is a specular reflector.

14. The element of claim 8, wherein the clear thermoplastic resin is selected from a group consisting of acrylics, polycarbonates, polyurethanes, polyolefins, polyesters, fluoropolymers, and polyvinyl chloride.

15. A method of providing retroreflectivity to a surface, comprising the steps of:

a) applying an adhesive to a surface; and b) applying plurality of discrete rigid retroreflective elements to the surface at random orientations, each element comprising a multi-sided retroreflector and a clear thermoplastic resin encasing the multi-sided retroreflector.

16. The method of claim 15, wherein step a) is done first.

* * * * *